US009903300B2

(12) United States Patent
Haag et al.

(10) Patent No.: US 9,903,300 B2
(45) Date of Patent: Feb. 27, 2018

(54) METHOD FOR SHUTTING DOWN AN ELECTRICALLY CONTROLLED COMPONENT OF A VEHICLE IN A CASE OF ERROR OF A PROCESSING UNIT CONTROLLING THE COMPONENT

(71) Applicant: Robert Bosch GmbH, Stuttgart (DE)

(72) Inventors: Wolfgang Haag, Winnenden (DE); Jochen Huber, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/211,550

(22) Filed: Jul. 15, 2016

(65) Prior Publication Data

US 2017/0022922 A1 Jan. 26, 2017

(30) Foreign Application Priority Data

Jul. 22, 2015 (DE) ..... 10 2015 213 831

(51) Int. Cl.

| | |
|---|---|
| ***F02D 41/26*** | (2006.01) |
| ***G07C 5/08*** | (2006.01) |
| ***F02D 41/22*** | (2006.01) |
| ***F02D 41/20*** | (2006.01) |

(52) U.S. Cl.

CPC ..... *F02D 41/26* (2013.01); *F02D 41/20* (2013.01); *F02D 41/221* (2013.01); *G07C 5/0841* (2013.01)

(58) Field of Classification Search

CPC ..... F02D 41/20; F02D 41/221; F02D 41/26; G07C 5/08; G07C 5/0841

USPC ..... 701/101–104, 107, 114, 115; 123/196 S, 123/198 D

See application file for complete search history.

(56) References Cited

U.S. PATENT DOCUMENTS

| | | | | |
|---|---|---|---|---|
| 5,880,568 | A | 3/1999 | Bederna et al. | |
| 6,359,439 | B1 * | 3/2002 | Crecelius | F02D 41/009 123/644 |
| 6,526,945 | B2 | 3/2003 | Herzog et al. | |
| 6,766,243 | B1 * | 7/2004 | Haussmann | F02D 41/266 123/339.11 |
| 6,955,164 | B2 * | 10/2005 | Kesler | G01K 7/01 123/630 |
| 9,151,238 | B2 * | 10/2015 | Ito | F02D 41/22 |
| 2002/0070557 | A1 * | 6/2002 | Geis | B60K 6/28 290/40 R |

(Continued)

FOREIGN PATENT DOCUMENTS

| | | |
|---|---|---|
| DE | 44 38 714 A1 | 5/1996 |
| DE | 100 22 956 A1 | 11/2001 |

*Primary Examiner* — John Kwon
*Assistant Examiner* — Johnny H Hoang
(74) *Attorney, Agent, or Firm* — Norton Rose Fulbright US LLP; Gerard Messina

(57) ABSTRACT

A method for shutting down an electrically controlled component of a vehicle in a case of error of a processing unit, the component being controlled by a control circuit, which receives at least one control signal from the processing unit and controls the component as a function of the at least one received control signal, the processing unit outputting the at least one control signal to a control terminal, the processing unit being designed for outputting an error signal having a defined level to the control terminal in a case of error.

14 Claims, 1 Drawing Sheet

(56) References Cited

U.S. PATENT DOCUMENTS

| | | | | |
|---|---|---|---|---|
| 2002/0198648 | A1* | 12/2002 | Gilbreth | H02J 1/10<br>701/100 |
| 2004/0245783 | A1* | 12/2004 | Gilbreth | H02J 1/14<br>290/52 |

* cited by examiner

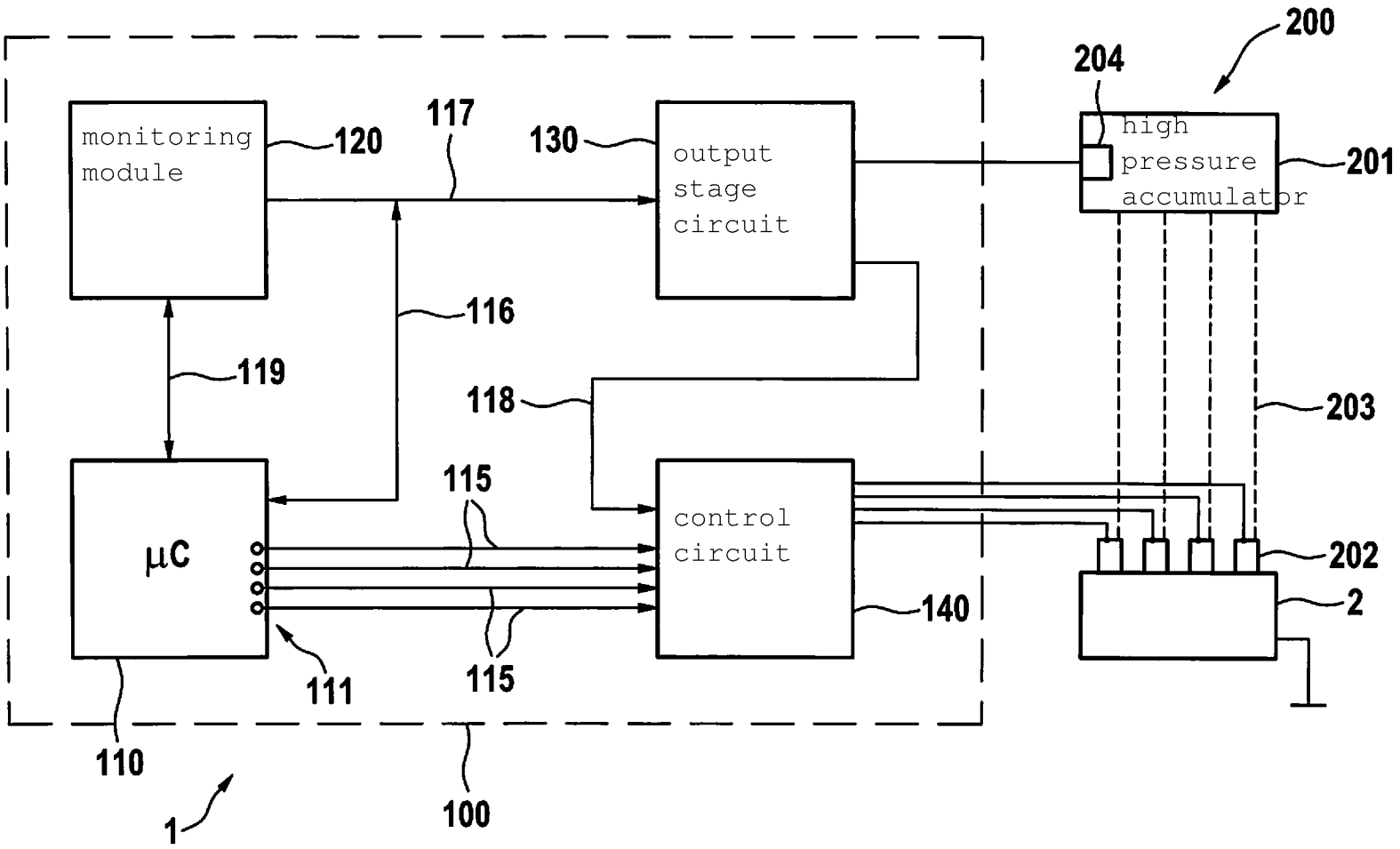
200
201
high pressure accumulator
204
203
202
2
140
output stage circuit
130
control circuit
118
115
115
100
117
116
120
monitoring module
119
µC
111
110
1

METHOD FOR SHUTTING DOWN AN ELECTRICALLY CONTROLLED COMPONENT OF A VEHICLE IN A CASE OF ERROR OF A PROCESSING UNIT CONTROLLING THE COMPONENT

CROSS REFERENCE

The present application claims the benefit under 35 U.S.C. § 119 of German Patent Application No. DE 102015213831.3 filed on Jul. 22, 2015, which is expressly incorporated herein by reference in its entirety.

FIELD

The present invention relates to a method for shutting down an electrically controlled component of a vehicle in a case of error of a processing unit as well as a processing unit and a computer program for carrying it out.

BACKGROUND INFORMATION

In engine control units of internal combustion engine (gasoline and diesel), the torque-determining injections are controlled by a microcontroller as a processing unit. Via its output ports, this microcontroller controls a downstream control circuit, in particular in the form of an application-specific integrated circuit (ASIC) having output stages (so-called injector output stage module), which in turn controls the injectors, i.e., usually connected in a defined manner to an energy or voltage source. Convention controls of injectors and suitable control circuits are described in, for example, German Patent Application No. DE 100 22 956 A1.

Injection systems are included in the safety-relevant systems, for which a safety concept is advantageous. This safety concept may, for example, be represented using a multi-level concept. In the case of safety-critical functional units in vehicles, for example, electronic throttle control systems (EGAS), a so-called three-level concept may be used, for example, in the operating control unit. Of essential importance is a mutual monitoring within the control unit between the function calculator (central processing unit, CPU) and a separate monitoring module (UM or watchdog). The function calculator and the monitoring module communicate via a question-and-answer communication and, in the case of error, may switch off power output stages in the control unit, which are provided for the operation of the functional unit and consequently ensure the safety of the vehicle. In present electronic throttle control systems, the entire function and monitoring software is located in a control unit, as is described in German Patent No. DE 44 38 714 A1.

To ensure safety, it should be possible in a case of error, for example, when the processing unit is defective, to transfer the injection system into a safe state via redundant disconnecting paths. In the case of error, for example, the monitoring module is able to deactivate the injection output stage module via a disable pin, as a result of which all individual injection output stages are deactivated within it with the aid of an internal logic, in order to shut down the injectors. In diesel systems, for example, the pressure control valve may be used as a redundant path. If it is open, it is not possible to inject any fuel under pressure. However, this method is not always applicable, since this component is not always installed.

The disconnecting paths should also generally be checked for their proper functioning at least once per driving cycle.

However, this is very complex in the case of most of the known disconnecting paths.

SUMMARY

According to the present invention, a method for shutting down an electrically controlled component of a vehicle in a case of error of a processing unit as well as a processing unit and a computer program for carrying it out are provided. Advantageous embodiments are described below.

The present invention provides a new disconnecting path, which is suitable for all components of a vehicle which are controlled by a processing unit with the aid of electrical control signals and is furthermore simple to test.

If the component is an injector, the present invention is in particular suitable for all types of internal combustion engines (i.e., in particular for both gasoline and diesel). This disconnecting path may be tested very rapidly and simply without additional test steps and consequently expenditure of time. The test may be carried out in particular already at a very early point in time in the control unit startup phase, even before the initialization of the injection system. Several of the previously very complex, error-prone and type dependent interfaces to the injection system may be replaced using this approach.

This disconnecting path may also be implemented without additional connections. The control leads are already present and only have to be configured appropriately.

Multiple integrated circuits usually interact for controlling electrically controlled components. For example, injectors are controlled with the aid of special control circuits (ASIC), which are responsible for the precise sequence of the control, a higher-level processing unit triggering each control action via a trigger signal (for example, a rising edge) on a trigger lead (usually a separate one for each injector). In the case of error, the trigger lead is in this example now set automatically to a fixed level, in particular HIGH, making it impossible to trigger any more injections. The use of a HIGH level as an error signal is particularly advantageous, since it may be used to overwrite signals having an arbitrary level. The disconnecting path according to the present invention may be used in particular as a redundant disconnecting path for the conventional disconnecting paths.

The present invention could be used for overwriting all types of control signals; in addition to trigger signals, this also includes in particular analog signals or data signals (e.g., CAN, FlexRay, Ethernet, SPI (serial peripheral interface), MSC (microsecond channel), etc.

A control action may, for example, comprise that for the purpose of control the control circuit connects the component to an energy source—for controlling injectors, for example, a voltage source. In particular, the component may be connected to the energy source directly by the control circuit via internal output stages (for example, open drain), as is the case, for example, in injectors for gasoline intake-manifold injection.

The present invention is in particular advantageous for implementation using the applicant's new control unit generation MDG1, since this control unit generation, in more precise terms, the associated central processing units (microcontrollers), offers a so-called PES feature (port emergency stop), in which any microcontroller port (terminal), thus, in particular including the trigger ports for the injection, may be configured in such a way that they are automatically set to HIGH in the case of error. A case of error is, for example, triggered by an error response by the monitoring module or a computer error. A computer error is detected via the EMM (error management module), which is internal to the microcontroller, without any software participation. This computer-internal module adds up computer-internal errors and offers the possibility of responding to errors appropriately using a configurable error response. In the computer specification, this module is, for example, referred to as 'FCCU' or 'SMU.' The vehicle is thus brought into a safe condition.

Preferably, the proper functioning of the shutdown is checked, in that the error signal having a HIGH level is output on a control terminal, while simultaneously, a test signal having a LOW level is output, and subsequently the resulting total signal is checked. If the total signal has a HIGH level, this means that the test signal was overwritten by the error signal and the shutdown is functional. Preferably, prior to the output of the error signal having a HIGH level, only the test signal having a LOW level is output and it is initially checked whether a LOW level is also actually present.

A processing unit according to the present invention, for example, a microcontroller of a control unit of a motor vehicle, is, in particular, programmed for carrying out a method according to the present invention.

The implementation of the method in the form of a computer program is also advantageous, since it entails very low costs, in particular when an executing control unit is also used for other tasks and is therefore present anyway. Suitable data media for providing the computer program are, in particular, magnetic, optical and electrical memories, such as hard drives, flash memories, EEPROMs, DVDs, etc. A download of a program via computer networks (Internet, Intranet, etc.) is also possible.

Additional advantages and embodiments of the present invention arise from the description herein and the FIGURES.

The present invention is schematically depicted in the FIGURE based on an exemplary embodiment and is described below with reference to the FIGURE.

BRIEF DESCRIPTION OF THE DRAWING

FIG. 1 schematically shows and in the form of a circuit diagram an injection system, in which a preferred specific embodiment of the present invention is implemented.

DETAILED DESCRIPTION OF EXAMPLE EMBODIMENTS

An injection system, in which a preferred specific embodiment of the present invention is implemented, is represented schematically and in the form of a circuit diagram in FIG. 1 and is generally denoted with reference numeral 1.

Injection system 1 is used for supplying fuel to an internal combustion engine 2. Injection system 1 includes an engine control unit 100 as well as a high-pressure fuel area 200 including a high-pressure accumulator (common rail) 201, a pressure control valve 204 attached to it, injectors 202 and associated supply lines 203.

Control unit 100 has, among other things, a processing unit designed as a microcontroller 110, a monitoring module 120, an output stage circuit 130 designed, for example, as an ASIC and a control circuit 140 designed, for example, as an ASIC for injectors 202.

Processing unit 110 is programmed for providing the proper functioning of engine control unit 100 and in particular for controlling injectors 202. For controlling injectors 202, control circuit 140 is provided, which controls injectors 202 according to four control leads formed here as trigger leads 115, which are in particular connected to voltage sources of varying levels, as is basically conventional. For this purpose, trigger signals are transferred to control circuit 140 on trigger leads 115 by processing unit 110, a separate control lead 115 being present for each injector 202 to be controlled. Control leads 115 are connected to control terminals 111 of processing unit 110.

The precise sequence of the control action, i.e., how long the injectors are acted upon using specific voltage levels, is predefined by control circuit 140 according to an internal program code. The program code is transferred to control circuit 140, in particular also by processing unit 110 via an additional connection (not shown), such as a bus.

Monitoring module 120 is designed for monitoring processing unit 110 and deactivating it in the case of error. For increasing the monitoring reliability, output stage circuit 130 (if it is torque-relevant) is also deactivated in the case of error by monitoring module 120 for redundancy reasons. In the process, monitoring module 120 is also able to deactivate control circuit 140 via output stage circuit 130 via signal lead 118. Simultaneously, processing unit 110 is also able to deactivate output stage circuit 130 and also control circuit 140 in the case of error. The corresponding signal leads 116, 117 are shown in the FIGURE.

Output stage circuit 130 is, for example, connected to pressure control valve 204 at high-pressure accumulator 201. In the case of the deactivation of output stage circuit 130, pressure control valve 204 is thus also opened, so that the pressure in high-pressure accumulator 201 is reduced and consequently it is not possible for an injection to be carried out with the aid of injectors 202.

In order to provide a redundant disconnecting path even in systems that do not have a pressure control valve for shutoff, the specific embodiment shown has a disconnecting path according to one preferred specific embodiment of the present invention, control terminals 111 of processing unit 110 being designed in such a way that they continuously output a HIGH level in the case of error. Subsequently, it is no longer possible to output a trigger signal via control terminals 111, so that another result of this is that it is no longer possible to inject fuel via injectors 202. Different error detection sources make it possible for control terminals 111 to carry out the error response HIGH level:

a) Monitoring module 120 detects an error in processing unit 110 (using the question-answer communication between monitoring module 120 and processing unit 110 via a connection 119 formed here as an SPI/MSC bus) and activates disconnecting path 117, which transfers an error signal directly to the processing unit via path 116. Via the PES configuration, the error pin activation automatically deactivates control terminals 111. No software function of the processing unit is necessary for the switching.

b) Using safety mechanisms (self-monitoring-on-chip such as command errors, memory errors (ECC . . . )), processing unit 110 detects an error and activates the control terminals via the EMM.

The redundant disconnecting path shown in the FIGURE is advantageous, since activation of the disconnecting path prevents any additional injection or torque buildup immediately and without a time delay and no dependencies of operating states are present.

If for safety reasons, it is necessary or advantageous to check this disconnecting path, this may preferably occur early or immediately after current is supplied to control unit 100 (in particular before the start of travel). In the case of such a startup, various tests and checks are carried out in any case in the related art. In particular, the proper functioning of the disconnecting path may be checked in a particularly simple manner, before control circuit 140 is started up. In this case, the signal levels on control leads 115 may still be set arbitrarily, without this having effects on internal combustion engine 2.

For an exemplary test, control terminals 111 are initially configured in particular as GPIO (general purpose inputs/outputs), and a test signal having a LOW level is output to each of control terminals 111. Subsequently, it is advantageously checked if a LOW level is actually present at control terminals 111.

Furthermore, control terminals 111 are configured in such a way that they output an error signal having a HIGH level (e.g., PES) in the case of error.

Subsequently, a case of error is simulated and the signal actually output at control terminals 111 is checked. If it is a signal having a HIGH level, the proper functioning of the disconnecting path is established.

Subsequently, control terminals 111 are again configured properly, i.e., they are configured in such a way that the trigger signals are output for controlling injectors 202.

Should the error or PES configuration for control terminals 111 be obstructive during the continued startup operation and the further ramp-up of control unit 100, this may be deactivated temporarily until normal operation is achieved.

If, however, normal operation is finally achieved (i.e., in particular, all shown components 110 through 140 are ready for operation), control terminals 111 are again configured in such a way that they now continuously output an error signal having a HIGH level in the case of error.

The present invention may be used not only for control leads in relation to the injection system, but instead also for switching off data transmission lines, for example, CAN, FlexRay or Ethernet transmissions, etc., in particular if they transmit monitoring-relevant messages and are to be switched off in the case of error of the processing unit.

What is claimed is:

1. A method for shutting down an electrically controlled component of a vehicle in a case of error of a processing unit, the electrically controlled component being controlled by a control circuit, the method comprising:

outputting, by the processing unit via a control terminal of the processing unit, at least one control signal;

receiving, by the control circuit, the control signal from the processing unit via a trigger lead connected to the control terminal;

triggering, by the control circuit, a function of the electrically controlled component based on the received control signal, the electrically controlled component performing the function based on the triggering;

detecting, by the processing unit, an error; and continuously outputting, by the processing unit, an error signal based on the detecting of the error, the error signal being a signal at a defined constant level, the error signal being continuously output by the processing unit via the same control terminal via which the control signal is output and the error signal is received by the control circuit via the same trigger lead via which the control circuit receives the control signal, the error signal blocking a further triggering of the function of the electrically controlled component.

2. The method as recited in claim 1, wherein the at least one control signal is one of: a trigger signal, an analog signal, or a data signal.

3. The method as recited in claim 1, wherein the processing unit outputs the error signal as a signal having a HIGH level to the control terminal based on detecting the error.

4. The method as recited in claim 1, wherein for purposes of control, the control circuit connects the component to an energy source.

5. The method as recited in claim 4, wherein the component is connected by the control circuit directly to an energy source via internal output stages.

6. The method as recited in claim 1, further comprising:

checking proper functioning of the shutdown by outputting, on the control terminal, a test signal having a LOW level, subsequently outputting the error signal as a signal having a HIGH level, and checking a resulting total signal.

7. The method as recited in claim 1, wherein the processing unit is a microcontroller.

8. The method as recited in claim 1, wherein the control circuit is an ASIC.

9. The method as recited in claim 1, wherein the electrically controlled component is one of an injector, an integrated circuit, a microcontroller or a processing unit, of an internal combustion engine.

10. The method as recited in claim 1, wherein the error is detected by a monitoring module superordinated to the processing unit.

11. The method as recited in claim 1, wherein the error is detected by an error monitoring process of the processing unit.

12. A system in a vehicle, comprising:

a processing unit having a control terminal, the processing unit being configured to output, via the control terminal, at least one control signal;

a control circuit connected to the control terminal of the processing unit via a trigger lead, the control circuit configured to receive the control signal from the processing unit via the trigger lead connected to the control terminal; and an electrically controlled component of the vehicle, the control circuit being configured to control the electrically controlled component, and to trigger a function of the electrically controlled component of the vehicle based on the received control signal, the electrically controlled vehicle being configured to perform the function based on the trigger;

wherein the processing unit is configured to detect an error, and to continuously output, via the same control terminal via which the control signal is output, an error signal, the error signal being a signal at a defined constant level, the error signal blocking a further triggering of the function of the electrically controlled component, and the error signal is received by the control circuit via the same trigger lead via which the control circuit receives the control signal.

13. The system as recited in claim 12, wherein the electrically controlled component is an injector of an internal combustion engine of the vehicle, and the control circuit is an ASIC.

14. The system as recited in claim 12, wherein the processing unit includes a monitoring module, the processing unit detecting the error via the monitoring module.

* * * * *